US011613331B2

(12) United States Patent
Lyon et al.

(10) Patent No.: US 11,613,331 B2
(45) Date of Patent: Mar. 28, 2023

(54) COMPOSITE MASTS AND MAST-FUSELAGE CONNECTION ASSEMBLIES FOR HYDROFOIL SPORTS BOARDS

(71) Applicant: BI THERMAL ASPEN EARTH, L.L.C., Salt Lake City, UT (US)

(72) Inventors: Tyler Lyon, Salt Lake City, UT (US); Aaron Best, Salt Lake City, UT (US)

(73) Assignee: Bi-Thermal Aspen Earth, L.L.C., Salt Lake City, UT (US)

( * ) Notice: Subject to any disclaimer, the term of this patent is extended or adjusted under 35 U.S.C. 154(b) by 50 days.

(21) Appl. No.: 17/193,506

(22) Filed: Mar. 5, 2021

(65) Prior Publication Data

US 2021/0276669 A1 Sep. 9, 2021

Related U.S. Application Data

(60) Provisional application No. 62/986,058, filed on Mar. 6, 2020.

(51) Int. Cl.

| | |
|---|---|
| ***B63B 32/66*** | (2020.01) |
| ***B63B 32/62*** | (2020.01) |
| ***B63B 1/24*** | (2020.01) |
| ***B63B 32/50*** | (2020.01) |

(52) U.S. Cl.

CPC ..... *B63B 32/66* (2020.02); *B63B 1/242* (2013.01); *B63B 32/50* (2020.02); *B63B 32/62* (2020.02)

(58) Field of Classification Search

CPC ..... B63B 1/242; B63B 1/246; B63B 1/248; B63B 32/10; B63B 32/50; B63B 32/60; B63B 32/62; B63B 32/64; B63B 32/66

See application file for complete search history.

(56) References Cited

U.S. PATENT DOCUMENTS

| | | | | |
|---|---|---|---|---|
| 9,085,343 | B2 * | 7/2015 | Modica | B63B 32/66 |
| 10,358,193 | B2 * | 7/2019 | Lobisser | B63B 32/64 |
| 11,345,449 | B2 * | 5/2022 | Sommerlatt | B63B 34/40 |

FOREIGN PATENT DOCUMENTS

| | | | | |
|---|---|---|---|---|
| DE | 202019003242 | U1 * | 9/2019 | |
| ES | 2740976 | B2 * | 3/2021 | B63B 1/242 |
| KR | 102103229 | B1 * | 4/2020 | B63B 1/242 |
| WO | WO-2022136566 | A1 * | 6/2022 | |

* cited by examiner

*Primary Examiner* — Ajay Vasudeva

(74) *Attorney, Agent, or Firm* — Bretton L. Crockett; TechLaw Ventures, PLLC

(57) ABSTRACT

This disclosure extends to systems, apparatus, and methods for sports board hydrofoil masts and mast-to-fuselage connection assemblies for hydrofoil sports boards. In one exemplary system, a hydrofoil mast formed as an elongated member may include a securing structure disposed in a lower region and a fuselage may include a recess into which the mast is inserted. A securing assembly may be disposed in the fuselage for actuation to secure the mast to the fuselage by interacting with the securing structure on the mast. The securing assembly may include a cam member or locking member and an actuating member. Unique hydrofoil masts constructed from composite materials having reinforcing metal members are disclosed and may be useful in the connection assemblies.

19 Claims, 6 Drawing Sheets

FIG. 3A
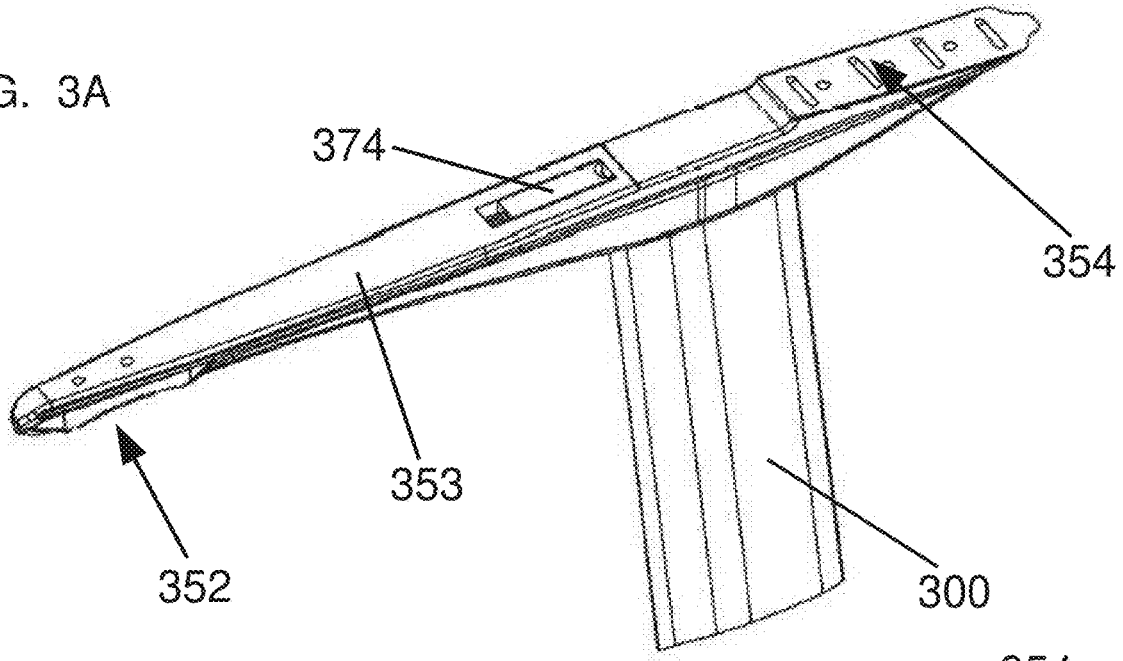
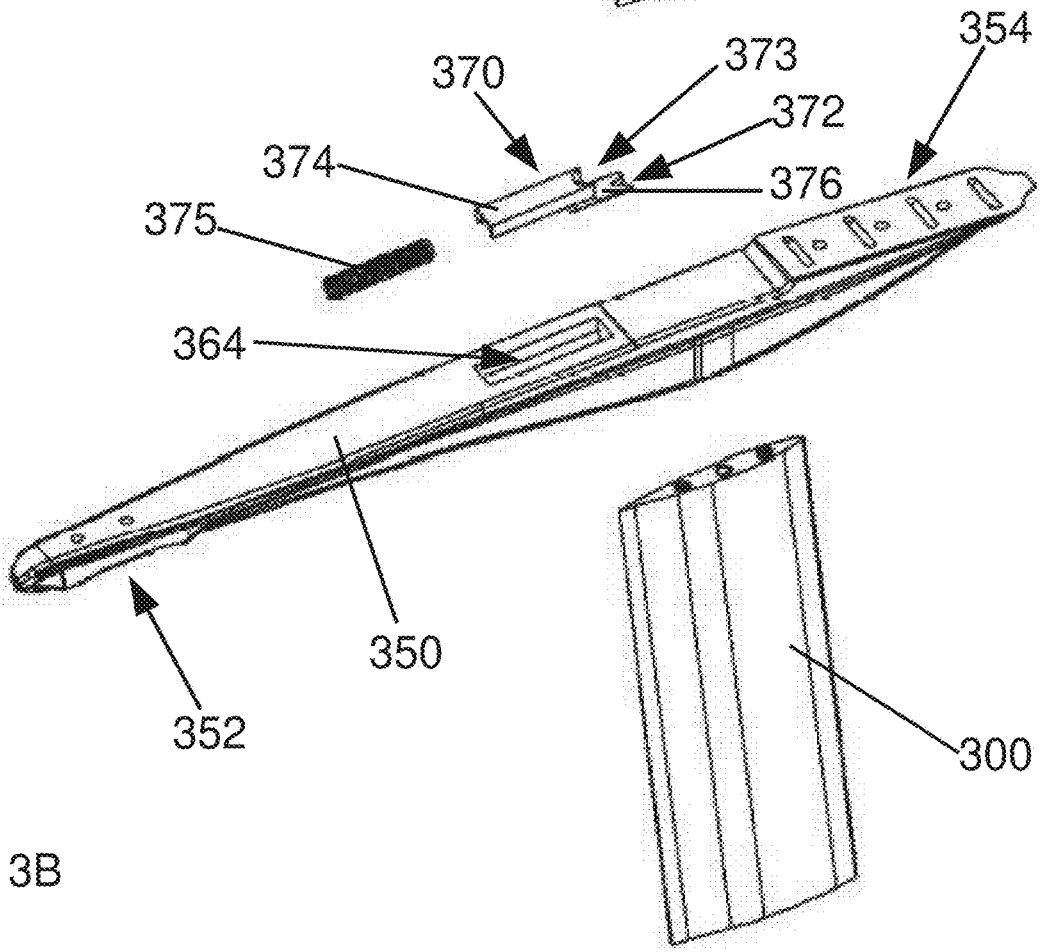
FIG. 3B

FIG. 4A
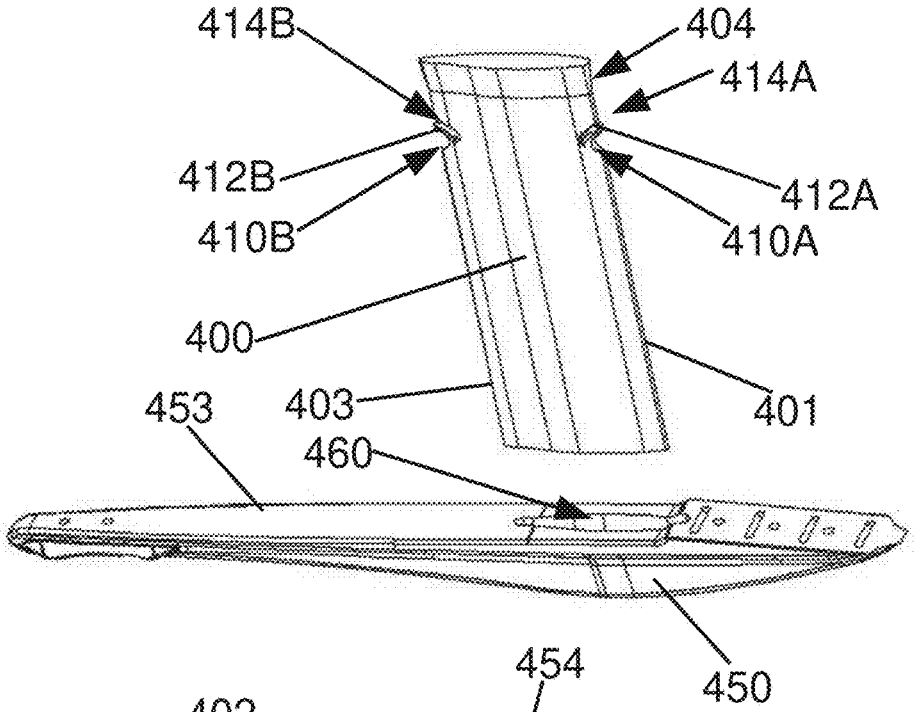
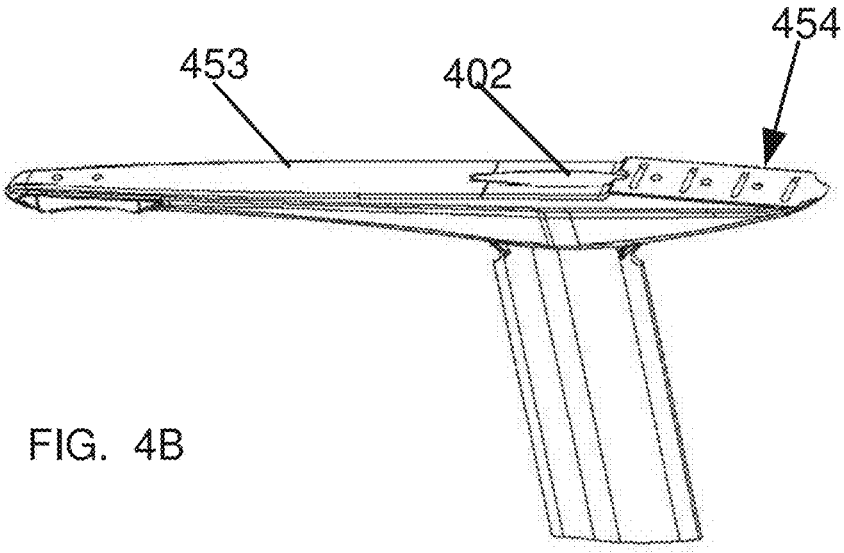
FIG. 4B
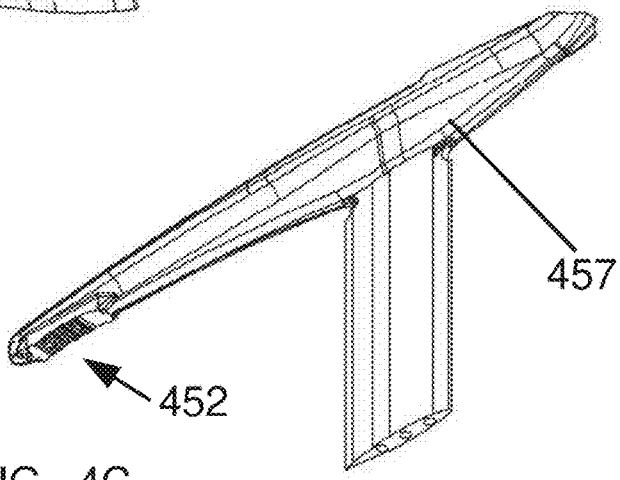
FIG. 4C

COMPOSITE MASTS AND MAST-FUSELAGE CONNECTION ASSEMBLIES FOR HYDROFOIL SPORTS BOARDS

CROSS-REFERENCE TO RELATED APPLICATION

This application claims the benefit of U.S. Provisional Application No. 62/986,058, filed Mar. 6, 2020, which is incorporated herein by reference in its entirety, including but not limited to those portions that specifically appear hereinafter.

BACKGROUND

The disclosure relates generally to methods, systems, and devices for the masts and fuselages for hydrofoil sports boards. Many current hydrofoil surfboards and water skis include front and rear planing blades, both disposed parallel to the elongate main board, on the front and rear of a fuselage support member attached to a mast extending downwards from the board. Typically, the mast and fuselage are constructed from metal alloys, including aluminum or steel alloys, and are formed as a unitary structure by casting or connected by welding. Such assemblies cannot be taken apart for storage or transport.

Systems or assemblies that provide a secure connection between a mast and a fuselage that can be repeatedly disconnected and reconnected would be an improvement in the art. Such systems that can be operated by a user without requiring a separate tool, or fastener for securing in place would be a further improvement in the art. Additionally, unique mast assemblies that use composite construction would be a further improvement in the art.

SUMMARY

This disclosure extends to systems, apparatus, and methods for sports board hydrofoil masts and mast-to-fuselage connection assemblies for hydrofoil sports boards. In one exemplary system, a hydrofoil mast formed as an elongated member may include a securing structure disposed in a lower region and a fuselage may include a recess into which the mast is inserted. A securing assembly disposed in the fuselage may be actuated to secure the mast to the fuselage by interacting with the securing structure on the mast. The securing assembly may include a cam member or locking member and an actuating member. Unique hydrofoil masts constructed from composite materials having reinforcing metal members are disclosed and may be useful in the connection assemblies.

The features and advantages of the disclosure will be set forth in the description, which follows, and in part will be apparent from the description, or may be learned by the practice of the disclosure without undue experimentation. The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base or were common general knowledge in the field relevant to the disclosure as it existed before the priority date of each claim of this disclosure.

BRIEF DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where:

FIGS. 3A and 3B illustrate bottom isometric views of a third illustrative embodiment of a mast-fuselage assembly for use with a waterski or surfboard system in an unassembled configuration and an assembled configuration, respectively.

FIGS. 4A, and 4B illustrate bottom isometric views of a fourth illustrative embodiment of a mast-fuselage assembly for use with a waterski or surfboard system in an unassembled configuration and an assembled configuration, respectively.

FIG. 4C illustrates a top isometric view of the embodiment of FIGS. 4A and 4B.

DETAILED DESCRIPTION

The disclosure extends to methods, systems, and devices for hydrofoil sports board assemblies allowing for the secure attachment and release of the mast to the fuselage. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

A first example of an embodiment of a hydrofoil fuselage and mast connection assembly for a sports board in accordance with the teachings of the present invention is depicted in FIGS. 1A, 1B, 1C, 1D, 1E and 1F.

Figure 1A:
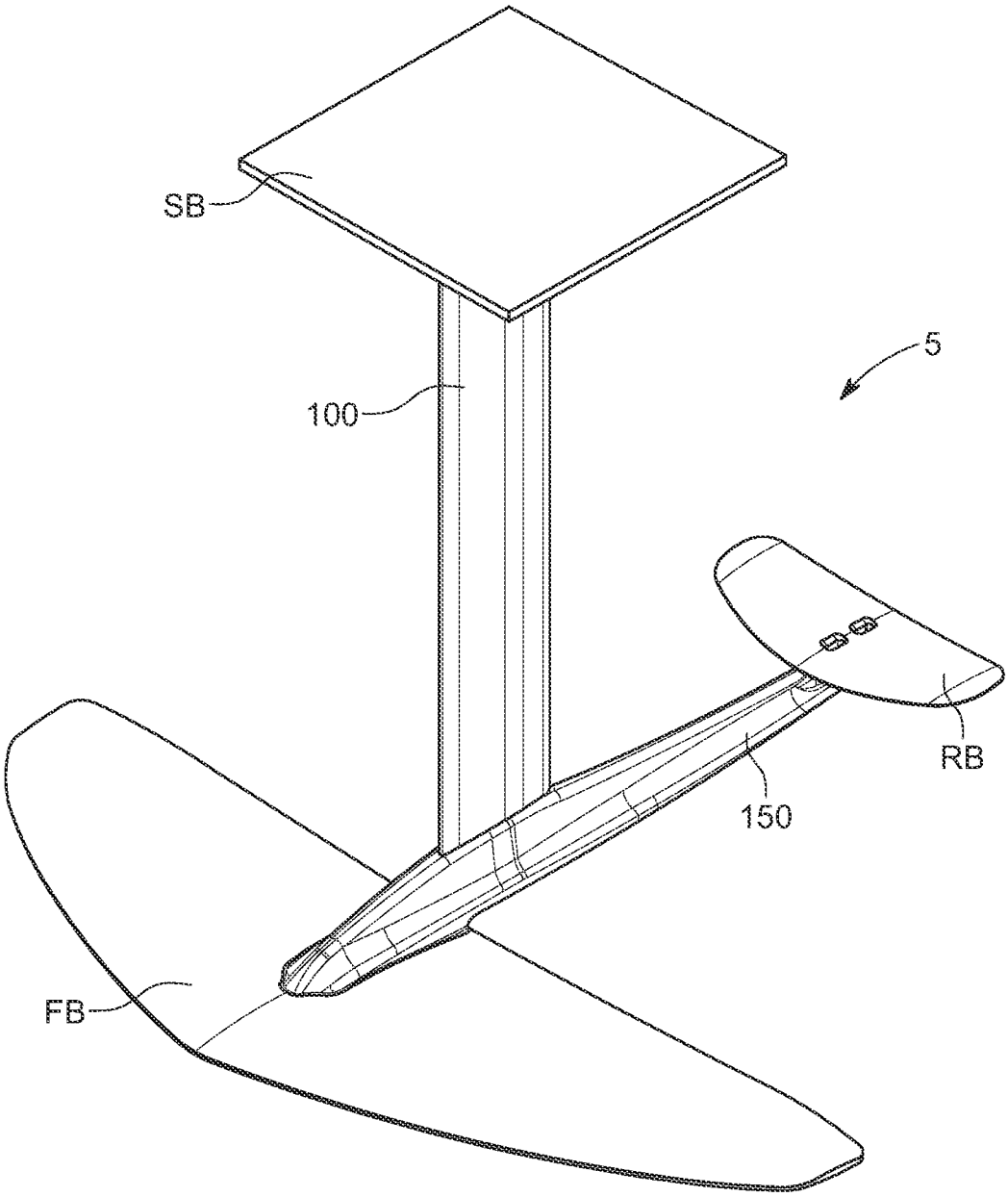
FIG. 1A depicts a top view of a mast-fuselage assembly in accordance with the present disclosure connected to planing blades and sports board for use.
Figure 1B:
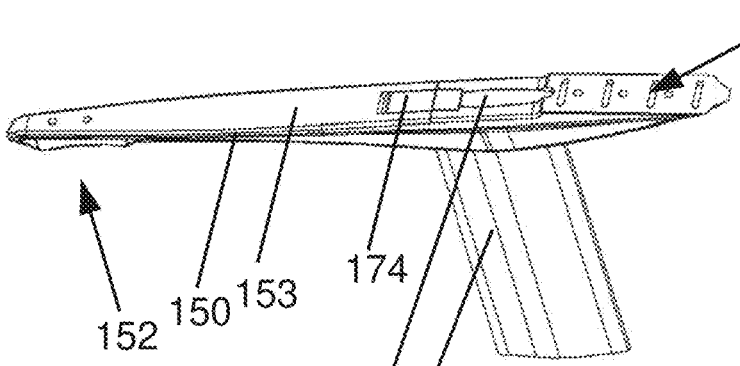
FIGS. 1B and 1C illustrate bottom isometric and top exploded views of a first illustrative embodiment of a mast-fuselage assembly for use with a waterski or surfboard system in an assembled configuration.
Figure 1C:
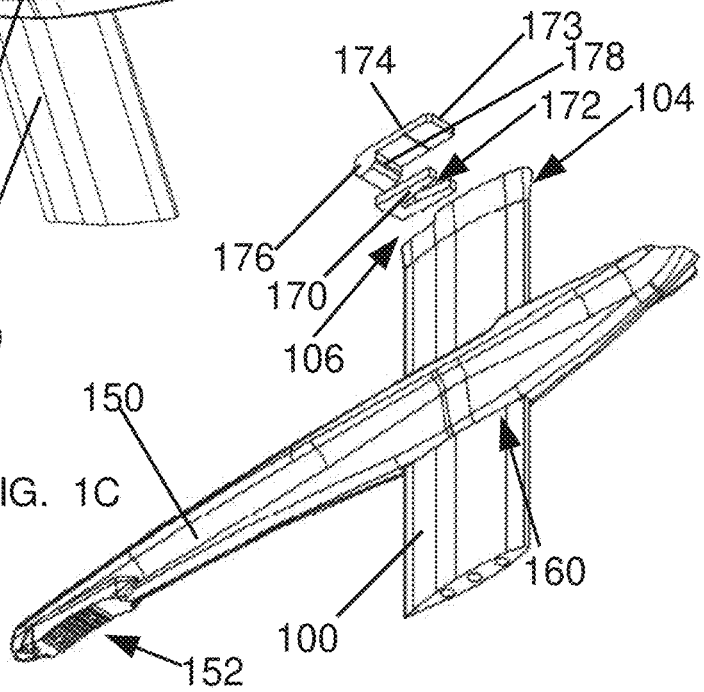

As depicted in FIG. 1A, an assembled hydrofoil assembly 5, may include a hydrofoil mast 100, formed as an elongated member extending from a top end (not depicted) that may be used to connect the complete assembly to the underside of a sports board, such as surfboard, body board or the like (which is generally indicated at SB by a small generic block to allow other details to be viewed) using suitable fasteners or a suitable connection system. At a lower end, mast 100 is attached to fuselage 150 which extends from a front end where front planing blade FB may be disposed to a rear end where a rear planing blade RB may be disposed.

Turning to FIGS. 1B, 1C, 1D, 1E and 1F, additional details of a hydrofoil fuselage 150, mast 100 and the mast connection assembly are depicted. As depicted, the mast 100 may have a smooth contoured surface for reduced drag in the water during use, such as a generally ovoid cross section having thinner leading and trailing ends.

Mast 100 may include a securing structure disposed in a lower region. In the depicted embodiment, the securing structure may be a flared lower portion 104 where the mast has an increased cross-sectional diameter. As depicted, bottom end 102 may also have a recessed rear portion 106.

Fuselage 150 may be a generally elongated member for connection to the mast 100 at an angle generally orthogonal thereto (and generally parallel to the sports board). Fuselage 150 may be configured for attaching planing fins thereto, as in the depicted embodiment where curved rear fin seat 154 and the planar forward fin seat 152 are present, with each containing ridges and ports for receiving structures for attachment of planing fins FB and RB thereto.

Fuselage 150 may include a mast recess 160 passing therethrough through which mast 100 is inserted for assembly. The mast recess 160 may be angled, or include a shelf therein, such that mast 100, when inserted from the bottom side through mast recess 160 passes therethrough until the flared portion 104 contacts the sidewalls thereof. As depicted, bottom end 102 may reside generally co-planar with bottom side 153 of the fuselage 150, when the mast is fully inserted. A securing assembly recess 164 may extend rearwards from the mast recess 160 and be sized and configured for receiving the securing assembly.

A securing assembly may be disposed in the fuselage 150 for securing the inserted mast. In the depicted embodiment, the securing assembly may include a locking member 170, which has a locking recess 172, configured to correspond to the shape of the mast 100, and a handle member 174, which may have a curved pivot base 176, a planar handle portion 173, and a cam surface 178 disposed under the handle on the pivot base. The securing assembly members may reside in the securing assembly recess 174 and be secured therein by an axle, or by notches or other structures formed therein, with locking member 170 slidably moveable in the direction of the long axis of the fuselage 150.

Figure 1D:
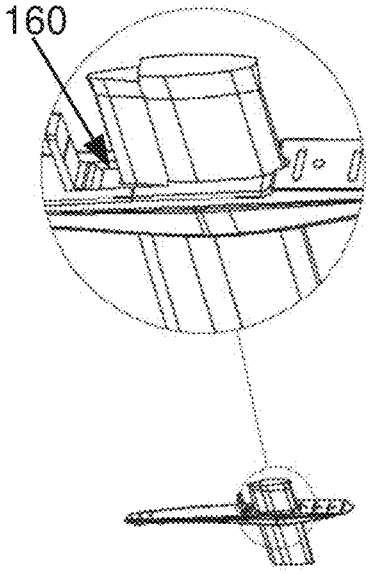
FIGS. 1D, 1E and 1F illustrate views of the assembly of FIGS. 1A through 1C being actuated to secure the mast to the fuselage.
Figure 1E:
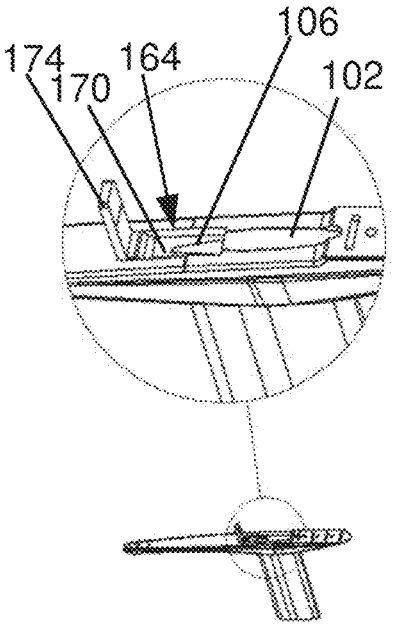
Figure 1F:
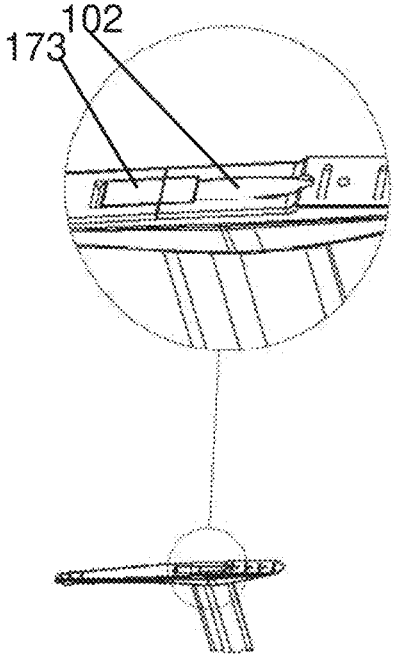

As depicted in FIGS. 1D, 1E and 1F, for use, with the handle member 174 rotated away from the fuselage 150 and the locking member 170 retracted, the mast 100 may be inserted through mast recess 160 from the bottom surface 153 side until the flared portion 104 contacts the recess sidewalls. Handle member 174 may then be rotated forwards and down to cause cam surface 178 to move the locking member 170 forward and the locking recess 172 sidewalls to contact the mast 100 and secure it in the fuselage 150 with handle member 174 contacting the recessed rear portion 106 of the mast lower surface 102. The fuselage lower surface 153, mast lower surface 102 and handle member 174 may be generally coplanar to provide a generally coplanar lower flat surface to reduce drag. For removal, the handle member 174 may be rotated in the opposite direction to release the locking member 170 allowing the mast 200 to be removed. It is noted that as the assembly is used, the forces on mast 100 press it rearward towards locking member 170, increasing the security of the connection.

Turning to FIGS. 2A, 2B, 2C, 2D and 2E, a second exemplary embodiment of a hydrofoil fuselage and mast connection assembly for a sports board in accordance with the teachings of the present invention is depicted. Hydrofoil mast 200, may be formed as an elongated member extending from a top end (not depicted) that may be used to connect the complete assembly to the underside of a sports board, such as surfboard, body board or waterski, using suitable fasteners or a suitable connection system. As depicted, the mast 200 may have a smooth contoured surface for reduced drag in the water during use, such as a generally ovoid cross section having thinner leading and trailing ends.

Mast 200 may include a securing structure disposed in a lower region. In the depicted embodiment, the securing structure may be a flared lower portion 204 where the mast has an increased cross-sectional diameter. As depicted, bottom end 202 may be generally planar.

Fuselage 250 may be a generally elongated member for connection to the mast 200 at an angle generally orthogonal thereto (and generally parallel to the sports board). Fuselage 250 may be configured for attaching planing fins thereto, as in the depicted embodiment where curved rear fin seat 254 and the planar forward fin seat 252 are present, with each containing ridges and ports for receiving structures for attachment of planing fins thereto.

Fuselage 250 may include a mast recess 260 passing therethrough through which mast 200 is inserted for assembly. The mast recess 260 may be angled, or include a shelf therein, such that mast 200, when inserted from the bottom side through mast recess 260 passes therethrough until the flared portion 204 contacts the sidewalls thereof. As depicted, bottom end 202 may reside generally co-planar with bottom side 253 of the fuselage 250, when the mast is fully inserted. A securing assembly recess 264 may extend rearwards from the mast recess 260 and be sized and configured for receiving the securing assembly. In the depicted embodiment, the mast recess 264 may have a planar bottom and open to the side for interacting with the securing assembly components.

A securing assembly may be disposed in the fuselage 250 for securing the inserted mast. In the depicted embodiment, the securing assembly may include a locking member 270, which has a locking recess 272, configured to correspond to the shape of the mast 200, and a handle member 274, which may have a curved pivot base 276, a planar handle portion 273, and a cam surface 278. As in the depicted embodiment, the handle member may be a planar member designed to pivot around the plane in a parallel direction. The securing assembly members may reside in the securing assembly recess 274 and be secured therein by an axle, or by notches or other structures formed therein, with locking member 270 slidably moveable in the direction of the long axis of the fuselage 250.

Figure 2A:
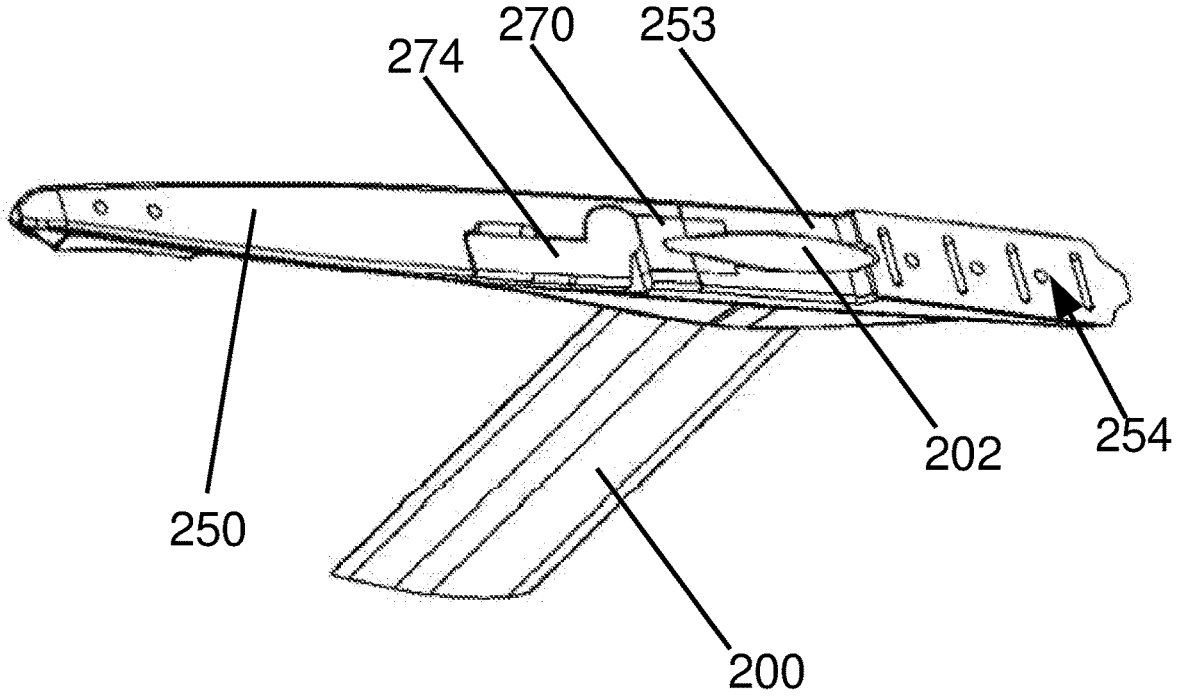
FIGS. 2A and 2B illustrate a bottom isometric and top exploded views of a second illustrative embodiment of a mast-fuselage assembly for use with a waterski or surfboard system in an assembled configuration.
Figure 2B:
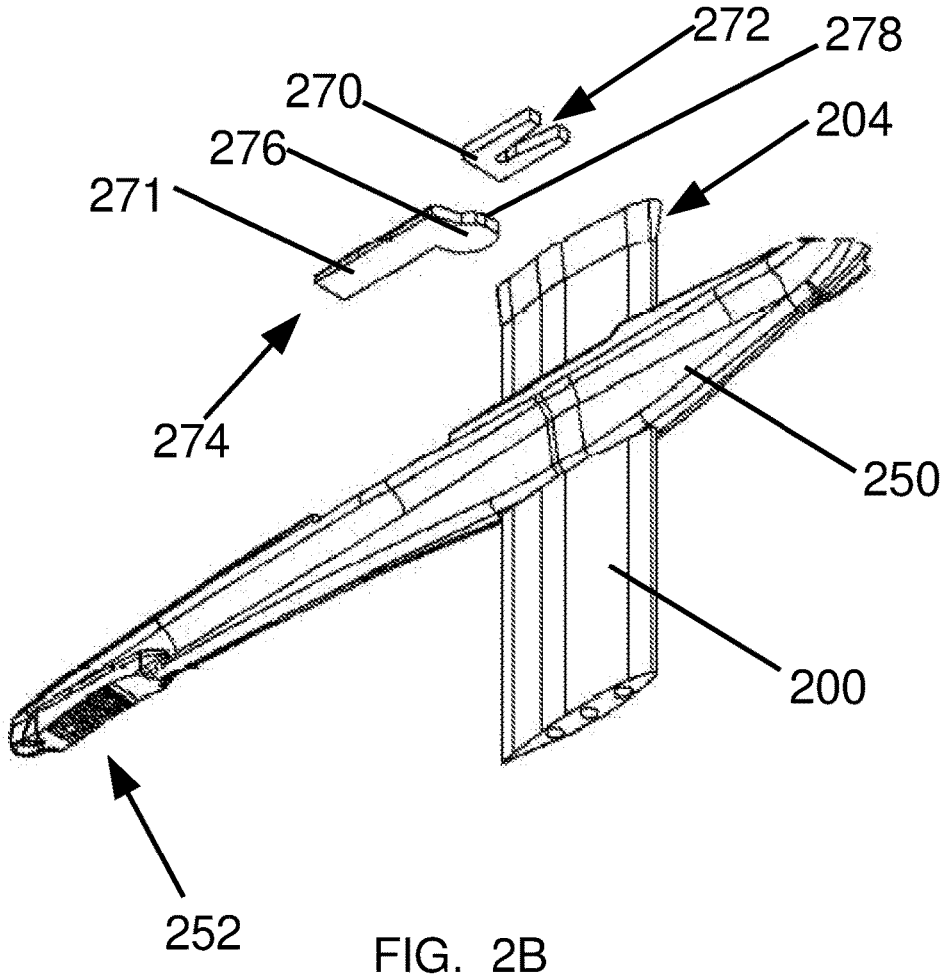
Figure 2C:
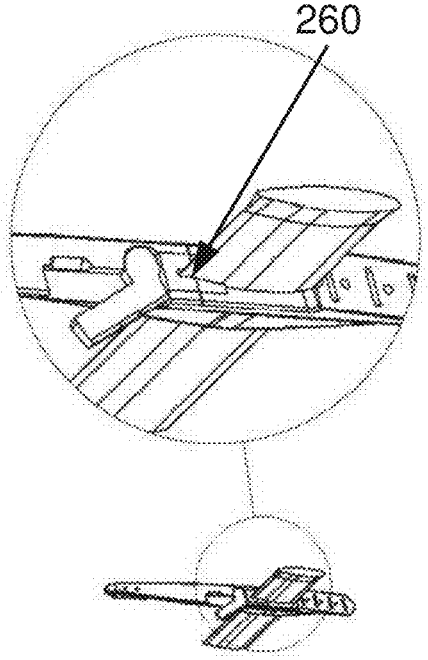
FIGS. 2C, 2D and 2E illustrate views of the assembly of FIGS. 2A and 2B being actuated to secure the mast to the fuselage.
Figure 2D:
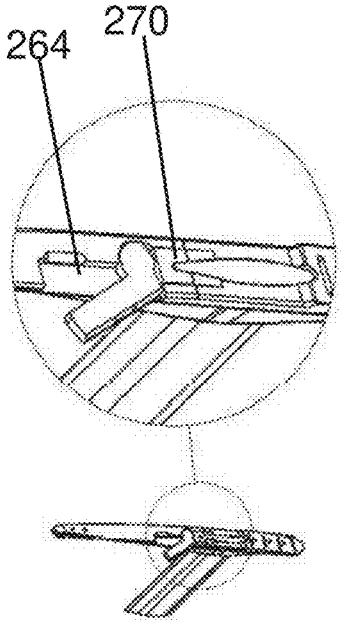
Figure 2E:
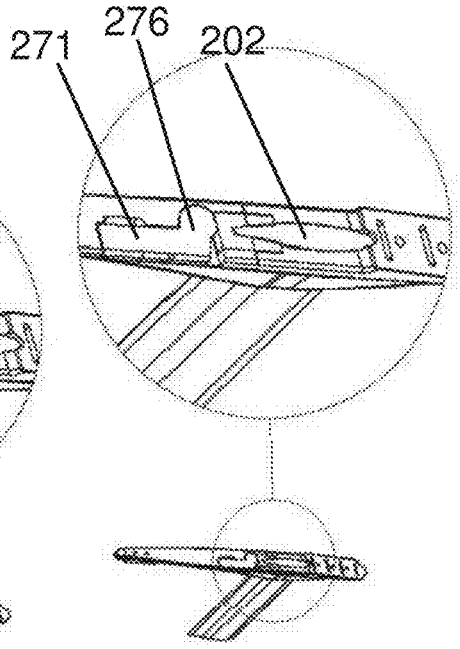

As depicted in FIGS. 2C, 2D and 2E, for use, with the handle member 274 rotated away from the fuselage 250 and the locking member 270 retracted, the mast 200 may be inserted through mast recess 260 from the bottom surface 253 side until the flared portion 204 contacts the recess sidewalls. Handle member 274 may then be rotated inwards to cause cam surface 278 to move the locking member 270 forward and the locking recess 272 sidewalls to contact the mast 200 and secure it in the fuselage 250. The fuselage lower surface 253, mast lower surface 202 and handle member 274 may be generally coplanar to provide a generally coplanar lower flat surface to reduce drag. For removal, the handle member 274 may be rotated in the opposite direction to release the locking member 270 allowing the mast 200 to be removed. It is noted that as the assembly is used, the forces on mast 200 press it rearward towards locking member 270, increasing the security of the connection.

Turning to FIGS. 3A and 3B, a third exemplary embodiment of a hydrofoil fuselage and mast connection assembly for a sports board in accordance with the teachings of the present invention is depicted. Hydrofoil mast 300, may be formed as an elongated member extending from a top end (not depicted) that may be used to connect the complete assembly to the underside of a sports board, such as surfboard, body board or waterski, using suitable fasteners or a suitable connection system. As depicted, the mast 300 may have a smooth contoured surface for reduced drag in the water during use, such as a generally ovoid cross section having thinner leading and trailing ends.

In some embodiments, mast 300 may include a securing structure disposed in a lower region, such as a notch for receiving a locking member. On other embodiments, a notch may not be needed. As depicted, bottom end 302 may be generally planar.

Fuselage 350 may be a generally elongated member for connection to the mast 300 at an angle generally orthogonal thereto (and generally parallel to the sports board). Fuselage 350 may be configured for attaching planing fins thereto, as in the depicted embodiment where curved rear fin seat 354 and the planar forward fin seat 352 are present, with each containing ridges and ports for receiving structures for attachment of planing fins thereto.

Fuselage 250 may include a mast recess open on an upper surface thereof, into which mast 300 is inserted for assembly. The mast recess may have a planar floor. A securing assembly recess 364 may open on the lower surface 353, connecting to the mast recess within the fuselage body and extend rearwards therefrom. The securing assembly recess 364 may be sized and configured for receiving the securing assembly.

A securing assembly may be disposed in the fuselage 350 for securing the inserted mast. In the depicted embodiment, the securing assembly may include a locking member 370, which has a handle portion 374 that may have a generally planar outer surface, a lower curved surface and extend from a rear side to a recessed front side 373. A locking portion 376 may be stepwise joined to the handle near the front side and extend forwards to a locking end containing a locking recess 372, configured to correspond to the shape of the mast 300, or to interact with a securing structure on the mast 300, where present. A spring 375 may be disposed underneath the handle portion 374 to provide forward bias between the rear wall of the securing assembly recess 364 and the locking portion 376. The securing assembly members may reside in the securing assembly recess 364 by notches or other structures formed therein or by the tension provided by spring 375, with locking member 370 slidably moveable in the direction of the long axis of the fuselage 350.

For use, a use may draw the locking member 370 rearward, as by inserting a finger into the recess and pressing against the recessed front side 373 of the handle portion 374 to retract the locking member 370. The mast 300 may be inserted through mast recess on the upper surface 353. The handle portion 374 may then be released, allowing spring 375 to move the locking member 370 forward and the locking recess 372 sidewalls to contact the mast 300 and secure it in the fuselage 350. The fuselage lower surface 353 and the handle portion 374 may be generally coplanar to provide a generally coplanar lower flat surface to reduce drag. A user may then draw the locking member 370 rearwards to remove the mast 300, when desired.

Turning to FIGS. 4A, 4B and 4C, another exemplary embodiment of a hydrofoil fuselage and mast connection assembly for a sports board in accordance with the teachings of the present invention is depicted. Hydrofoil mast 400, may be formed as an elongated member extending from a top end (not depicted) that may be used to connect the complete assembly to the underside of a sports board, such as surfboard, body board or waterski, using suitable fasteners or a suitable connection system, to a bottom end 402 which may be generally planar. As depicted, the mast 400 may have a smooth contoured surface for reduced drag in the water during use, such as a generally ovoid cross section having thinner leading and trailing ends.

Mast 400 may include securing structures disposed in a lower region. In the depicted embodiment, the securing structure may include a flared lower portion 404 where the mast has an increased cross-sectional diameter. As depicted, additional securing structures may be present, such as flexible locking tabs 414A and 414B, which are disposed on the front and rear edges 401 and 401, respectively, of the mast 400. Each locking tab is formed as a member extending outwards from the edges of the mast in generally downwards direction. Each may have a relatively larger upper notch 410A or 410B, and a relatively smaller lower notch 412A or 412B disposed on the mast edge above and below the tab 414A or 414B.

Fuselage 450 may be a generally elongated member for connection to the mast 400 at an angle generally orthogonal thereto (and generally parallel to the sports board). Fuselage 450 may be configured for attaching planing fins thereto, as in the depicted embodiment where curved rear fin seat 454 and the planar forward fin seat 452 are present, with each containing ridges and ports for receiving structures for attachment of planing fins thereto.

Fuselage 450 may include a mast recess 460 passing therethrough through which mast 400 is inserted for assembly. The mast recess 460 may be angled, or include a shelf therein, such that mast 400, when inserted from the bottom side through mast recess 460 passes therethrough until the flared portion 404 contacts the sidewalls thereof. As depicted, bottom end 402 may reside generally co-planar with bottom side 453 of the fuselage 450, when the mast is fully inserted.

As the mast 400 is inserted through mast recess 460, the flexible members 414A and 414B are compressed into the lower recesses 412A and 412B, until passing through the body of the fuselage above the upper surface 457. The flexible members 414A and 414B then flex outwards, to abut the upper surface 457 and prevent the mast 400 from being withdrawn. The fuselage lower surface 453 and mast lower surface 402 may be generally coplanar to provide a generally coplanar lower flat surface to reduce drag. For removal, the upper notches 410A and 414B may be grasped by a user to further draw the mast 400 through the opening 460, allowing the flexible members 414A and 414B to be flexed downwards into the lower notches 412A and 412B, and the mast 400 withdrawn. It will be appreciated the flexible member 414A and 414B may be constructed of a suitable composite material, which may be the same material as the mast 400 body.

Figure 5A:
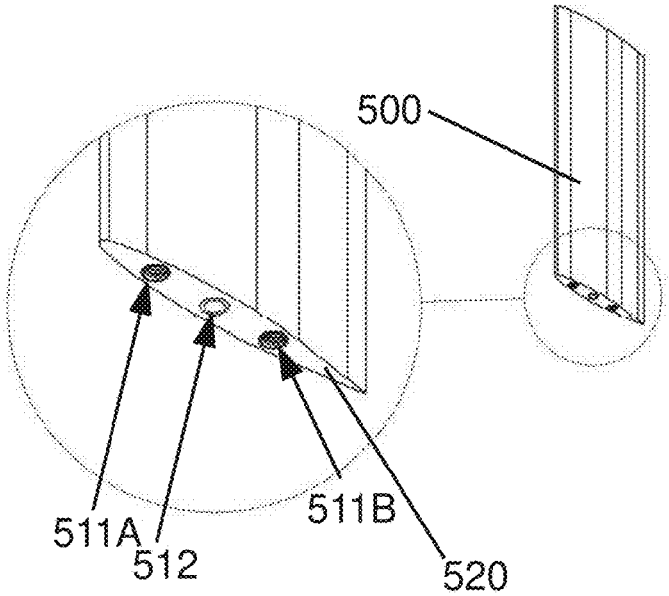
FIGS. 5A and 5B illustrate isometric views of a hydrofoil mast useful with embodiments of the present disclosure.
Figure 5B:
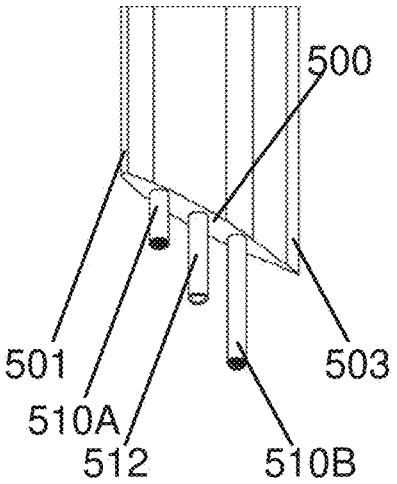

FIGS. 5A and 5B depict a hydrofoil mast 500 which may be especially useful in connection assemblies in accordance with the present disclosure. Hydrofoil mast 500 may be formed as an elongated member extending from a top end (not depicted) that may be used to connect the complete assembly to the underside of a sports board, such as surfboard, body board or waterski, using suitable fasteners or a suitable connection system, to a bottom end 520, which is depicted as generally planar for illustrative purposes. As depicted, the mast 500 may be formed as a body 502 having a smooth contoured surface for reduced drag in the water during use, such as a generally ovoid cross section having thinner leading and trailing ends with front and rear edges 501 and 503.

As best depicted in the cutaway view of FIG. 5B, the body 502 or mast 500 may be constructed from a suitable composite material, such as a glass filled nylon or other polymer having suitable properties for the intended usage. One or more metal members may be disposed in the body and extend in the longitudinal direction to provide reinforcement. In the depicted embodiment, there are three metal members, two solid metal rods 510A and 510B and a metal tube 512 having a central bore. Such a hollow tube may provide reinforcement at a reduced weight. As depicted in the enlarged portion of FIG. 5A, at an end of the mast 500, the sold metal rods 510A and 510B may be drilled and threaded to provide threaded metal receptacles for attachment. It will be appreciated that the number and type of reinforcing rods and the particular shape and size of the mast may vary based on the intended use. Mast 500 may be constructed by molding the composite material of the body 502 around the reinforcing members.

It will be further appreciated that the components of the mast to fuselage connection assemblies in accordance with the present disclosure may be formed from any suitable material having sufficient strength and durability to serve during the intended use. For example, glass-filled nylon which is injection molded into the desired shapes could be used.

In the foregoing Detailed Description, various features of the disclosure are grouped together in a single implementation for streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It will be further appreciated that the embodiments depicted and discussed in this disclosure are exemplary rather than limiting. It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A mast-to-fuselage assembly for hydrofoil sports boards, comprising:

a hydrofoil mast formed as an elongated member and including a securing structure; and;

a fuselage configured for attachment at least one planning blade, wherein the fuselage comprises a mast attachment recess is disposed in the fuselage, where a bottom surface of the hydrofoil mast is coplanar with a bottom surface of the fuselage when secured in the mast attachment recess; and a securing assembly that is actuatable to releasably secure the hydrofoil mast to the fuselage by interacting with the securing structure.

2. The assembly of claim 1, wherein the securing assembly includes a slidable locking member that extends to a first position to interact with the securing structure and secure the mast to the fuselage and retracts to a second position to allow the hydrofoil mast to be removed from the fuselage.

3. The assembly of claim 2, wherein the slidable locking member defines a notch shaped to correspond to a rear edge of the hydrofoil mast that contacts the hydrofoil mast in the extended position.

4. The assembly of claim 2, wherein the securing assembly further comprises an actuating member that moves the locking member into and away from the first position.

5. The assembly of claim 2, wherein the securing assembly further includes a spring that retains the locking member in the first position.

6. The assembly of claim 1, wherein the securing structure comprises a flared end of the hydrofoil mast.

7. The assembly of claim 1, wherein the securing structure comprises at least one notch formed in the hydrofoil mast.

8. The assembly of claim 7, wherein the securing structure comprises at least one flexible member attached to the hydrofoil mast and disposed in the at least one notch.

9. The assembly of claim 1, wherein the hydrofoil mast comprises a body formed from a composite material surrounding a plurality of reinforcing metal members.

10. A hydrofoil assembly, comprising:

a hydrofoil mast formed as an elongated member with a flared lower end;

a fuselage formed as an elongated member with at least one planning blade attached at an end thereof, and comprising a mast attachment recess defined as a bore in the fuselage that is generally orthogonal to a long axis of the fuselage, where a bottom surface of the hydrofoil mast is coplanar with a bottom surface of the fuselage when secured in the mast attachment recess; and a securing assembly that secures the mast in the mast attachment recess in a first position and allows the mast to be removed from the mast attachment recess in a second position.

11. The assembly of claim 10, wherein the securing assembly includes a slidable locking member that extends to the first position and retracts to the second position.

12. The assembly of claim 11, wherein the slidable locking member defines a notch shaped to correspond to a rear edge of the hydrofoil mast at a point above the flared lower end.

13. The assembly of claim 11, wherein the securing assembly further comprises an actuating member that moves the locking member into and away from the first position.

14. The assembly of claim 11, wherein the securing assembly further includes a spring disposed in the fuselage and in contact with the locking member that retains the locking member in the first position.

15. The assembly of claim 10, wherein the hydrofoil mast comprises a body formed from a composite material surrounding a plurality of reinforcing metal members.

16. A mast-to-fuselage assembly for hydrofoil sports boards, comprising:

a hydrofoil mast formed as an elongated member and including a securing structure; and;

a fuselage configured for attachment at least one planning blade, wherein the fuselage comprises a mast attachment recess is disposed in the fuselage, and a securing assembly that is actuatable to releasably secure the hydrofoil mast to the fuselage by interacting with the securing structure, wherein the securing assembly includes a slidable locking member that extends to a first position to interact with the securing structure and secure the mast to the fuselage and retracts to a second position to allow the hydrofoil mast to be removed from the fuselage, the securing assembly further comprising an actuating member that moves the locking member into and away from the second position wherein the actuating member includes a pivot surface for rotation and a camming surface that interacts with the locking member and the actuating member is rotated.

17. A hydrofoil assembly, comprising:

a hydrofoil mast formed as an elongated member with a flared lower end;

a fuselage formed as an elongated member with at least one planning blade attached at an end thereof, and comprising a mast attachment recess defined as a bore in the fuselage that is generally orthogonal to a long axis of the fuselage, and a securing assembly that secures the mast in the mast attachment recess in a first position and allows the mast to be removed from the mast attachment recess in a second position, wherein the securing assembly includes a slidable locking member that extends to the first position and retracts to the second position, the securing assembly comprising an actuating member that moves the locking member into and away from the first position which includes a pivot surface for rotation and a camming surface that interacts with the locking member and the actuating member is rotated.

18. A hydrofoil assembly, comprising:

a hydrofoil mast formed as an elongated member with a flared lower end;

a fuselage formed as an elongated member with at least one planning blade attached at an end thereof, and comprising a mast attachment recess defined as a bore in the fuselage that is generally orthogonal to a long axis of the fuselage, and a securing assembly that secures the mast in the mast attachment recess in a first position and allows the mast to be removed from the mast attachment recess in a second position, wherein the securing assembly includes a slidable locking member that extends to the first position and retracts to the second position, the securing assembly comprising an actuating member that moves the locking member into and away from the first position, wherein the fuselage further defines a securing assembly recess in which the actuating member pivots.

19. The assembly of claim 18, wherein the hydrofoil mast includes a notched in to receive the actuating member.

* * * * *